US005629120A

United States Patent [19]

Serizawa et al.

[11] Patent Number: 5,629,120

[45] Date of Patent: May 13, 1997

[54] ELECTROSTATIC IMAGE DEVELOPING CARRIER AND ELECTROSTATIC IMAGE DEVELOPER

[75] Inventors: Manabu Serizawa; Ikutaroh Nagatsuka; Haruhide Ishida; Sakon Takahashi, all of Minami-ashigara, Japan

[73] Assignee: Fuji Xerox Co., Ltd., Tokyo, Japan

[21] Appl. No.: 543,343

[22] Filed: Oct. 16, 1995

[30] Foreign Application Priority Data

Oct. 31, 1994 [JP] Japan ..... 6-266770

[51] Int. Cl.[6] ..... G03G 9/107

[52] U.S. Cl. ..... 430/106.6; 430/108

[58] Field of Search ..... 430/106.6, 108, 430/110, 137

[56] References Cited

U.S. PATENT DOCUMENTS 3,996,392 12/1976 Berg et al. ..... 430/108

5,376,488 12/1994 Ohmura et al. ..... 430/108

FOREIGN PATENT DOCUMENTS

A-2-37366 2/1990 Japan .

A-5-150565 6/1993 Japan .

*Primary Examiner*—John Goodrow

*Attorney, Agent, or Firm*—Oliff & Berridge

[57] ABSTRACT

The present invention provides an electrostatic image developing carrier which exhibits an enhanced maintenance of image quality, can be prevented from being attached to the image and thus can provide an image free of uneven density and background stain and an electrostatic image developer comprising said carrier. A novel electrostatic image developing carrier comprising a ferrite is provided, characterized in that said ferrite has a copper content of from 0.1 ppm to 2,500 ppm, a zinc content of from 0.1 ppm to 5,000 ppm and a nickel content of from 0.1 ppm to 2,000 ppm.

10 Claims, No Drawings

ELECTROSTATIC IMAGE DEVELOPING CARRIER AND ELECTROSTATIC IMAGE DEVELOPER

FIELD OF THE INVENTION

The present invention relates to an electrostatic image developing carrier for use in the development of an electrostatic image formed by electrophotography, electrostatic recording, etc. and a developer comprising said carrier.

BACKGROUND OF THE INVENTION

A method for the visualization of image data via electrostatic image such as electrophotography is utilized in various fields at present. In electrophotography, an electrostatic latent image is formed on a photoreceptor via charging step and exposure step. The electrostatic latent image thus formed is then developed with a developer comprising a toner. The image thus developed is then visualized via transfer step and fixing step. The developer for use in electrophotography is divided into two types, i.e., two-component developer comprising a toner and a carrier and single-component developer comprising a toner singly, such as magnetic toner. In the two-component developer, the carrier serves to agitate, carry and charge the developer and thus two components for the developer each has a different function. Thus, the two-component developer features a good controllability and is widely used at present.

In particular, a developer comprising a carrier which has a core coated with a resin has an excellent controllability and can be relatively easily subjected to improvement in environmental dependence and age stability. As the developing method there was once used cascade method. At present, a magnetic brush method using a magnetic roll as a developer carrier is mostly used.

The magnetic brush method using a two-component developer is disadvantageous in that the chargeability deterioration of the developer causes a drop of image density and a remarkable stain on the background and the attachment of the carrier to the image gives defective image or causes excessive consumption of the carrier or gives uneven image density. The chargeability deterioration of the developer can easily occur when the toner components are fixed to the coated layer of the carrier or the coated layer is peeled. Further, if the coated layer is nonuniform, it tends to cause stain on the background when the environmental factors such as humidity and temperature are changed, when the toner is additionally supplied or when the toner concentration becomes high.

The mechanism of the attachment of the carrier to the image is considered as follows. In some detail, when the coated layer is nonuniform or peeled, causing a drop of the electrical resistance of the carrier, induced electric charge is injected into the image zone to cause the carrier to be attached to the image, particularly to the edge of the image.

The adjustment of the electrical resistance of the carrier is proposed in JP-A-2-37366 (The term "JP-A" as used herein means an "unexamined published Japanese patent application") and JP-A-5-150565. However, these publications have no reference to countermeasure against the drop of the electrical resistance of the carrier due to the peeling of the coating resin.

As a coating method for fixing the coated layer more uniformly and firmly there has been proposed a method which comprises mixing a magnetic core with a powdered coating material in a dry condition and, heat-melting the mixture to form a coated layer. However, taking into account the recent trend toward smaller particle diameter of toner grains and lower melting point of toner material for higher image quality, the foregoing proposed method cannot necessarily exert a sufficient effect of solving the foregoing problems.

SUMMARY OF THE INVENTION

It is therefore an object of the present invention to provide an electrostatic image developing carrier having the following features and an electrostatic image developer comprising said carrier:

1) The injection of charge into the image portion can be prevented to secure a high image quality;
2) The attachment of carrier can be prevented to secure a high image quality while reducing the consumption of carrier;
3) An image quality that can give an excellent reproduction of black solid and fine line can be provided and the photoreceptor can be prevented against damage and black spot; and
4) An inexpensive core material for carrier having uniform surface properties and composition can be secured.

The foregoing object of the present invention will become more apparent from the following detailed description and examples.

The foregoing object of the present invention can be accomplished by the following constitution of the present invention:

(1) An electrostatic image developing carrier comprising ferrite, which has a copper content of from 0.1 ppm to 2,500 ppm, a zinc content of from 0.1 ppm to 5,000 ppm and a nickel content of from 0.1 ppm to 2,000 ppm.

(2) The electrostatic image developing carrier according to item (1), said ferrite is covered by a synthetic resin so that the ferrite forms a core.

(3) The electrostatic image developing carrier according to item (2), wherein the synthetic resin to cover the core of the ferrite is from 0.5 to 5% by weight based on the carrier.

(4) The electrostatic image developing carrier according to item (2) or (3), wherein the average particle diameter of the core is from 20 to 120 μm.

(5) An electrostatic image developer, comprising an electrostatic image developing carrier according to any one of items (1) to (4) and a toner having an average particle diameter of from 5 to 15 μm.

DETAILED DESCRIPTION OF THE INVENTION

The inventors paid their attention to ferrite to be blended in the carrier and made extensive studies of the foregoing problems. As a result, the foregoing problems can be solved by the incorporation of copper content, zinc content and nickel content in specified proportions. In some detail, the incorporation of copper in an amount of from 0.1 to 2,500 ppm, zinc in an amount of from 0.1 to 5,000 ppm, and nickel in an amount of from 0.1 to 2,000 ppm; preferably copper in an amount of from 1 to 2,000 ppm, zinc in an amount of from 1 to 4,000 ppm, and nickel in an amount of from 1 to 1,500 ppm; more preferably, copper in an amount of from 10 to 1,500 ppm, zinc in an amount of from 10 to 3,000 ppm and nickel in an amount of from 10 to 1,000 ppm; and most preferably, copper in an amount of from 10 to 1,000 ppm, zinc in an amount of from 10 to 1,500 ppm, and nickel in an amount of from 10 to 500 ppm makes it possible to control the electrical resistance of the particulate ferrite to a specified range and form a proper unevenness during sintering of the particulate ferrite.

The content of the metallic components in the foregoing ferrite can be determined as follows:

The sample is added to hot concentrated nitric acid (16N). The solution is allowed to stand for about 1 hour, and then cooled. Hydrogen peroxide is then added to the solution. The solution is heated, and then cooled. Concentrated hydrochloric acid is added to the solution which is then heated and cooled. The solution is filtered, and then subjected to atomic-absorption spectroscopy.

If the content of the copper, zinc and nickel components exceed the above defined ranges, the particulate ferrite has low electrical resistance, making the image portion more injectable by charge. In order to inhibit the injection of electric charge, an approach has been proposed which comprises the application of an insulating resin or the like to control the electrical resistance of the carrier. However, this approach is disadvantageous in that the resin thus applied can be made peelable when the carrier is stirred, possibly making it impossible to maintain the predetermined electrical resistance.

On the contrary, if the content of the copper, zinc and nickel components fall below the above defined ranges, the productivity of the carrier becomes low. In some detail, it is made difficult to form a proper unevenness during the production of the particulate ferrite. Thus, even if the electrical resistance of the particulate ferrite is properly controlled by the application of a resin or the like, electric charge can be easily injected into the image portion through protrusions. In order to obtain a proper unevenness during sintering of the particulate ferrite, a high temperature (e.g., approx. 1,500° C.) is needed, causing thereby high cost in production thereof.

As the particulate ferrite to be used in the present invention, particularly as a carrier core, there may be preferably used a ferrite containing therein a divalent matal such as Mn, Mg, Ca, Sr and Ti. When the ferrite is constituted by only the metal disclosed above, the temperature required for sintering is too high. Therefore, sintering can be lowered by the incorporation of a low sintering element such as Cu and Ni in the present invention. If the content of Cu and Ni each fall below 0.1 ppm, the foregoing effect cannot be exerted. On the contrary, if the content of Cu exceeds 2,500 ppm and the content of Ni exceeds 2,000 ppm, the resulting electrical resistance is too low. Zn exerts an effect of enhancing the magnetic force of the ferrite. However, if the content of Zn falls below 0.1 ppm, the foregoing effect cannot be exerted. On the contrary, if the content of Zn exceeds 5,000 ppm, it is disadvantageous in that the required sintering temperature is too high.

Among the divalent metals constituting the skeleton of the ferrite, Mn, Mg and Ca are appropriate to provide the surface of the particulate ferrite with a better unevenness.

When the foregoing particulate ferrite is used as a core, the injection of charge into the image portion or the attachment of the carrier to the image portion can be prevented even if the coating resin is peeled off the surface of the carrier because the particulate ferrite itself exhibits an electrical resistance as high as from $1\times10^{7}$ to $1\times10^{10}$ Ω·cm in the electrical voltage range of from 50 to 2,000 V.

As the carrier according to the present invention there may be used the foregoing particulate ferrite as it is. In order to provide a proper electrification, the particulate ferrite may be coated with a synthetic resin.

The preferable coating synthetic resin employable in the present invention include vinyl polymers, silicone polymers, polyester polymers or a mixture thereof. Of them, vinyl polymers are preferred, and acrylic acid polymers and esters thereof are more preferred. Examples thereof include homopolymers and copolymers of vinyl fluorine-containing monomer such as vinylidene fluoride, tetrafluoroethylene, hexafluoropropylene, monochlorotrifluoroethylene and trifluoroethylene; vinyl aromatic monomer such as styrene, chlorostyrene and methylstyrene; α-methylene aliphatic monocarboxylic acid and ester thereof such as (meth)acrylic acid, methyl (meth)acrylate, ethyl (meth)acrylate, propyl (meth)acrylate, butyl (meth)acrylate, lauryl (meth)acrylate, 2-ethylhexyl (meth)acrylate and phenyl (meth)acrylate; nitrogen-containing acrylate such as dimethylaminoethyl (meth)acrylate; nitrile such as (meth)acrylonitrile; vinylpyridine such as 2-vinylpyridine and 4-vinylpyridine; vinyl ether; vinyl ketone; olefin such as ethylene, monochloroethylene, propylene and butadiene; silicone such as methyl silicone and methylphenyl silicone; and other homopolymers and copolymers. Further, polyesters containing bisphenol, glycol, etc. can be used. The foregoing coating resins may be used in admixture. Of them, polymers containing fluorine atom are preferred.

The ferrite used in the present invention is prepared, for example, by a process comprising adding metal oxide, such as oxide of Cu, Zn, Ni, Ca, Mn, Mg, Si and Ti, in an appropriate amount to magnetite powder having about 0.1 μm of diameter; mixing with stirring using Atliter, etc., dispersing the mixture into water or an aqueous solution of water-soluble high polymeric material such as cellulose, polyvinylalcohol, polyethyleneglycol, etc. to form a slurry, drying the slurry thus obtained with a spray-dryer to be granulated, and sintering at a temperature of 900° C. to 1600° C. under a nitrogen gas atmosphere.

The total mixing proportion of the coating resin is from 0.5 to 5.0% by weight, preferably from 1.0 to 3.0% by weight based on the weight of the carrier in view of satisfying the requirements for image quality, secondary hindrance and chargeability simultaneously.

The application of the coating resin to the core of the present invention can be accomplished by means of a heated kneader, heated Henschel mixture, UM mixer, planetary mixer or the like.

The ferrite core particles to be used in the present invention are almost spherical and have an average diameter of from 20 to 120 μm, preferably from 30 to 80 μm.

The carrier of the present invention may be mixed with a toner to form a two-component developer. The toner comprises a colorant, etc. dispersed in a binder resin. Examples of the binder resin include homopolymers or copolymers of monomer, e.g., vinyl aromatic monomer such as styrene, para-chlorostyrene and α-methyl styrene; α-methylenealiphatic monocarboxylate such as methyl (meth)acrylate, ethyl (meth)acrylate, n-propyl (meth) acrylate, lauryl (meth)acrylate and 2-ethylhexyl (meth) acrylate; vinyl nitrile such as acrylonitrile and methacrylonitrile; vinyl pyridine such as 2-vinyl pyridine and 4-vinyl pyridine; vinyl ether such as vinyl methyl ether and vinyl isobutyl ether; vinyl ketone such as vinyl methyl ketone, vinyl ethyl ketone and vinyl isopropyl ketone; unsaturated hydrocarbon such as ethylene, propylene, isoprene and butadiene and halide thereof; and halogenic unsaturated hydrocarbon (e.g., chloroprene), copolymer of two or more of these monomers, mixture thereof. Examples of the binder resin further include non-vinyl condensed resin such as rosin-modified phenol-formaldehyde resin, epoxy resin, polyester resin, polyurethane resin, polyamide resin, cellulose resin and polyether resin, and mixture of these non-vinyl condensed resin with the foregoing vinyl resins.

In the binary developer, the toner is used in an amount of from 1 to 20 parts by weight based on 100 parts of the carrier.

Examples of coloring agent to be incorporated in the toner include carbon black, nigrosine dye, aniline blue, chalocoyl blue, chrome yellow, ultramarine blue, methylene blue, rose bengal, phthalocyanine blue, and mixture thereof.

The toner comprises a charge controller, an offset inhibitor, a fluidity improver, etc. besides the colorant. If necessary, the toner of the present invention may comprise fine particles of magnetic material incorporated therein.

The trend is the reduction of the diameter of the toner particles for higher image quality. The average diameter of the toner particles is preferably from 5 to 15 μm, more preferably from 5 to 10 μm.

The present invention will be further described in the following examples, but the present invention should not be construed as being limited thereto. The term "parts" as used hereinafter are by weight.

PARTICULATE CORE PREPARATION EXAMPLE 1

As ferrite components there were used 100 parts of a mixture of 60.33 mol % of $Fe_2O_3$, 29.66 mol % of MnO, 0.02 mol % of CuO, 0.01 mol % of ZnO and 0.01 mol % of NiO and 1.2 parts of $SiO_2$. These components were wet-milled to a grain diameter of from 0.01 to 1 μm by a ball mill, dry-crushed, and then crushed to a grain diameter of from 0.1 to 1.5 mm by a crusher. The material was then wet-milled by a ball mill to form a slurry. To the slurry thus formed was then added 0.8% of a polyvinyl alcohol as a binder. The material was then subjected to granulation by spray drying method to form spherical grains. The material thus granulated was sintered at a temperature of 1,330° C., and then classified to obtain a particulate core having an average diameter of 50 μm. The particulate core thus obtained was then subjected to determination of Cu, Zn and Ni. As a result, the content of Cu, Zn and Ni were found to be 180 ppm, 50 ppm and 70 ppm, respectively. The electrical resistance of the particulate was $8.4\times10^9$ Ω·cm at 100 V or $6.9\times10^9$ Ω·cm at 2,000 V.

PARTICULATE CORE PREPARATION EXAMPLE 2

As ferrite components there were used 100 parts of a mixture of 57.4 mol % of $Fe_2O_3$, 41.1 mol % of CaO, 1.1 mol % of CuO, 0.3 mol % of ZnO and 0.1 mol % of NiO, and 1.2 parts of $SiO_2$. These components were milled, granulated, sintered at a temperature of 1,210° C., and then classified in the same manner as in Example 1 to obtain a particulate core having an average diameter of 50 μm. The particulate core thus obtained was then subjected to determination of Cu, Zn and Ni. As a result, the content of Cu, Zn and Ni were found to be 1,030 ppm, 2,200 ppm and 1,600 ppm, respectively. The electrical resistance of the particulate core was $1.4\times10^8$ Ω·cm at 100 V or $5.7\times10^7$ Ω·cm at 2,000 V.

PARTICULATE CORE PREPARATION EXAMPLE 3

As ferrite components there were used 100 parts of a mixture of 50.9 mol % of $Fe_2O_3$, 49.1 mol % of MgO, 0.001 mol % of CuO, 0.001 mol % of ZnO and 0.01 mol % of NiO, and 1.1 parts of $SiO_2$. These components were milled, granulated, sintered at a temperature of 1,290° C., and then classified in the same manner as in Example 1 to obtain a particulate core having an average diameter of 50 μm. The particulate core thus obtained was then subjected to determination of Cu, Zn and Ni. As a result, the content of Cu, Zn and Ni were found to be 30 ppm, 15 ppm and 20 ppm, respectively. The electrical resistance of the particulate core was $2.4\times10^9$ Ω·cm at 100 V or $1.0\times10^9$ Ω·cm at 2,000 V.

PARTICULATE CORE PREPARATION EXAMPLE 4

As ferrite components there were used 100 parts of a mixture of 80.1 mol % of $Fe_2O_3$, 17.8 mol % of MnO, 0.2 mol % of CuO, 0.5 mol % of ZnO and 0.01 mol % of NiO, and 1.4 parts of $SiO_2$. These components were milled, granulated, sintered at a temperature of 1,250° C., and then classified in the same manner as in Example 1 to obtain a particulate core having an average diameter of 50 μm. The particulate core thus obtained was then subjected to determination of Cu, Zn and Ni. As a result, the content of Cu, Zn and Ni were found to be 2,000 ppm, 100 ppm and 70 ppm, respectively. The electrical resistance of the particulate core was $4.2\times10^9$ Ω·cm at 100 V or $1.8\times10^9$ Ω·cm at 2,000 V.

PARTICULATE CORE PREPARATION EXAMPLE 5

As ferrite components there were used 100 parts of a mixture of 64.2 mol % of $Fe_2O_3$, 33.7 mol % of CaO, 2.0 mol % of CuO, 0.01 mol % of ZnO and 0.01 mol % of NiO, and 1.2 parts of $SiO_2$. These components were milled, granulated, sintered at a temperature of 1,310° C., and then classified in the same manner as in Example 1 to obtain a particulate core having an average diameter of 50 μm. The particulate core thus obtained was then subjected to determination of Cu, Zn and Ni. As a result, the content of Cu, Zn and Ni were found to be 200 ppm, 4,000 ppm and 70 ppm, respectively. The electrical resistance of the particulate core was $6.3\times10^9$ Ω·cm at 100 V or $3.6\times10^9$ Ω·cm at 2,000 V.

PARTICULATE CORE PREPARATION EXAMPLE 6

As ferrite components there were used 100 parts of a mixture of 55.1 mol % of $Fe_2O_3$ and 44.9 mol % of CaO, and 1.1 parts of $SiO_2$. These components were milled, granulated, sintered at a temperature of 1,290° C., and then classified in the same manner as in Example 1 to obtain a particulate core having an average diameter of 50 μm. The particulate core thus obtained was then subjected to determination of Cu, Zn and Ni. As a result, the content of Cu, Zn and Ni were found to be 0.05 ppm, 0.02 ppm and 0.01 ppm, respectively. The electrical resistance of the particulate core was $2.2\times10^{10}$ Ω·cm at 100 V or $1.9\times10^{10}$ Ω·cm at 2,000 V.

PARTICULATE CORE PREPARATION EXAMPLE 7

As ferrite components there were used 100 parts of a mixture of 52.9 mol % of $Fe_2O_3$, 13.7 mol % of MgO, 30.1 mol % of CuO, 3.2 mol % of ZnO and 0.1 mol % of NiO, and 1.1 parts of $SiO_2$. These components were milled, granulated, sintered at a temperature of 1,360° C., and then classified in the same manner as in Example 1 to obtain a particulate core having an average diameter of 50 μm. The particulate core thus obtained was then subjected to determination of Cu, Zn and Ni. As a result, the content of Cu, Zn and Ni were found to be 37,000 ppm, 20,000 ppm and 1,200 ppm, respectively. The electrical resistance of the particulate core was $4.0\times10^8$ Ω·cm at 100 V or $2.2\times10^5$ Ω·cm at 2,000 V.

PARTICULATE CORE PREPARATION EXAMPLE 8

As ferrite components there were used 100 parts of a mixture of 58.3 mol % of $Fe_2O_3$, 40.8 mol % of MnO, 0.2 mol % of CuO, 0.2 mol % of ZnO and 0.5 mol % of NiO, and 1.1 parts of $SiO_2$. These components were milled, granulated, sintered at a temperature of 1,190° C., and then classified in the same manner as in Example 1 to obtain a particulate core having an average diameter of 50 μm. The particulate core thus obtained was then subjected to determination of Cu, Zn and Ni. As a result, the content of Cu, Zn and Ni were found to be 1,000 ppm, 1,000 ppm and 3,000 ppm, respectively. The electrical resistance of the particulate core was $5.5\times10^9$ Ω·cm at 100 V or $4.3\times10^8$ Ω·cm at 2,000 V.

PARTICULATE CORE PREPARATION EXAMPLE 9

As ferrite components there were used 100 parts of a mixture of 54.3 mol % of $Fe_2O_3$, 44.7 mol % of MnO, 0.7 mol % of CuO, 0.2 mol % of ZnO and 0.1 mol % of NiO, and 1.4 parts of $SiO_2$. These components were milled, granulated, sintered at a temperature of 1,300° C., and then classified in the same manner as in Example 1 to obtain a particulate core having an average diameter of 50 μm. The particulate core thus obtained was then subjected to determination of Cu, Zn and Ni. As a result, the content of Cu, Zn and Ni were found to be 3,000 ppm, 1,000 ppm and 1,000 ppm, respectively. The electrical resistance of the particulate core was $3.8\times10^{10}$ Ω·cm at 100 V or $9.6\times10^8$ Ω·cm at 2,000 V.

PARTICULATE CORE PREPARATION EXAMPLE 10

As ferrite components there were used 100 parts of a mixture of 59.7 mol % of $Fe_2O_3$, 38.8 mol % of MnO, 0.2 mol % of CuO, 1.2 mol % of ZnO and 0.1 mol % of NiO and 1.2 parts of $SiO_2$. These components were milled, granulated, sintered at a temperature of 1,330° C., and then classified in the same manner as in Example 1 to obtain a particulate core having an average diameter of 50 μm. The particulate core thus obtained was then subjected to determination of Cu, Zn and Ni. As a result, the content of Cu, Zn and Ni were found to be 1,000 ppm, 7,000 ppm and 1,000 ppm, respectively. The electrical resistance of the particulate core was $7.0\times10^9$ Ω·cm at 100 V or $1.5\times10^9$ Ω·cm at 2,000 V.

EXAMPLE 1

1,000 parts of the manganese ferrite obtained in Particulate Core Preparation Example 1 were added to 500 parts of a toluene solution of 5 parts of methyl polymethacrylate (BR-87, available from Mitsubishi Rayon Co., Ltd.). The mixture was then stirred at room temperature and atmospheric pressure for 15 minutes to make a solution. The solution was then heated under reduced pressure with stirring to remove toluene as the solvent therefrom. Thereafter, the residue was sieved through a 105-μm mesh sieve to obtain a carrier.

EXAMPLE 2

1,000 parts of the calcium ferrite obtained in Particulate Core Preparation Example 2 were added to 500 parts of a toluene solution of 5 parts of methyl polymethacrylate (BR-87, available from Mitsubishi Rayon Co., Ltd.). The mixture was then stirred at room temperature and atmospheric pressure for 15 minutes to make a solution. The solution was then heated under reduced pressure with stirring to remove toluene as the solvent therefrom. Thereafter, the residue was sieved through a 105-μm mesh sieve to obtain a carrier.

EXAMPLE 3

1,000 parts of the magnesium ferrite obtained in Particulate Core Preparation Example 3 were added to 500 parts of a toluene solution of 5 parts of methyl polymethacrylate (BR-87, available from Mitsubishi Rayon Co., Ltd.). The mixture was then stirred at room temperature and atmospheric pressure for 15 minutes to make a solution. The solution was then heated under reduced pressure with stirring to remove toluene as the solvent therefrom. Thereafter, the residue was sieved through a 105-μm mesh sieve to obtain a carrier.

EXAMPLE 4

1,000 parts of the manganese ferrite obtained in Particulate Core Preparation Example 4 were added to 500 parts of a toluene solution of 5 parts of methyl polymethacrylate (BR-87, available from Mitsubishi Rayon Co., Ltd.). The mixture was then stirred at room temperature and atmospheric pressure for 15 minutes to make a solution. The solution was then heated under reduced pressure with stirring to remove toluene as the solvent therefrom. Thereafter, the residue was sieved through a 105-μm mesh sieve to obtain a carrier.

EXAMPLE 5

1,000 parts of the calcium ferrite obtained in Particulate Core Preparation Example 5 were added to 500 parts of a toluene solution of 5 parts of methyl polymethacrylate (BR-87, available from Mitsubishi Rayon Co., Ltd.). The mixture was then stirred at room temperature and atmospheric pressure for 15 minutes to make a solution. The solution was then heated under reduced pressure with stirring to remove toluene as the solvent therefrom. Thereafter, the residue was sieved through a 105-μm mesh sieve to obtain a carrier.

EXAMPLE 6

1,000 parts of the manganese ferrite obtained in Particulate Core Preparation Example 1 were added to 500 parts of a toluene solution of 5 parts of perfluoro-octylethyl methacrylate-methyl methacrylate copolymer (available from Soken Chemical Co., Ltd., $M_w$=62000, copolymer ratio=3:7). The mixture was then stirred at room temperature and atmospheric pressure for 15 minutes to make a solution. The solution was then heated under reduced pressure with stirring to remove toluene as the solvent therefrom. Thereafter, the residue was sieved through a 105-μm mesh sieve to obtain a carrier.

COMPARATIVE EXAMPLE 1

1,000 parts of the calcium ferrite obtained in Particulate Core Preparation Example 6 were added to 500 parts of a toluene solution of 5 parts of methyl polymethacrylate (BR-87, available from Mitsubishi Rayon Co., Ltd.). The mixture was then stirred at room temperature and atmospheric pressure for 15 minutes to make a solution. The solution was then heated under reduced pressure with stirring to remove toluene as the solvent therefrom. Thereafter, the residue was sieved through a 105-μm mesh sieve to obtain a carrier.

COMPARATIVE EXAMPLE 2

1,000 parts of the magnesium ferrite obtained in Particulate Core Preparation Example 7 were added to 500 parts of a toluene solution of 5 parts of methyl polymethacrylate (BR-87, available from Mitsubishi Rayon Co., Ltd.). The mixture was then stirred at room temperature and atmospheric pressure for 15 minutes to make a solution. The solution was then heated under reduced pressure with stirring to remove toluene as the solvent therefrom. Thereafter, the residue was sieved through a 105-μm mesh sieve to obtain a carrier.

COMPARATIVE EXAMPLE 3

1,000 parts of the manganese ferrite obtained in Particulate Core Preparation Example 8 were added to 500 parts of a toluene solution of 5 parts of methyl polymethacrylate (BR-87, available from Mitsubishi Rayon Co., Ltd.). The mixture was then stirred at room temperature and atmospheric pressure for 15 minutes to make a solution. The solution was then heated under reduced pressure with stirring to remove toluene as the solvent therefrom. Thereafter, the residue was sieved through a 105-μm mesh sieve to obtain a carrier.

COMPARATIVE EXAMPLE 4

1,000 parts of the manganese ferrite obtained in Particulate Core Preparation Example 9 were added to 500 parts of a toluene solution of 5 parts of methyl polymethacrylate (BR-87, available from Mitsubishi Rayon Co., Ltd.). The mixture was then stirred at room temperature and atmospheric pressure for 15 minutes to make a solution. The solution was then heated under reduced pressure with stirring to remove toluene as the solvent therefrom. Thereafter, the residue was sieved through a 105-μm mesh sieve to obtain a carrier.

COMPARATIVE EXAMPLE 5

1,000 parts of the manganese ferrite obtained in Particulate Core Preparation Example 10 were added to 500 parts of a toluene solution of 5 parts of methyl polymethacrylate (BR-87, available from Mitsubishi Rayon Co., Ltd.). The mixture was then stirred at room temperature and atmospheric pressure for 15 minutes to make a solution. The solution was then heated under reduced pressure with stirring to remove toluene as the solvent therefrom. Thereafter, the residue was sieved through a 105-μm mesh sieve to obtain a carrier.

(Preparation of Toner)

87 parts of a binder resin (styrene-n-butyl methacrylate), 8 parts of carbon black (BPL, available from Cabot), 1 part of a charge controller (TRH, available from Hodogaya Chemical Co., Ltd.), and 4 parts of a polypropylene wax (660P, available from Sanyo Chemical Industries, Ltd.) were then subjected to melt kneading to obtain a-particulate toner having an average grain diameter of 7.5 μm. To 100 parts of the particulate toner was then added 1 part of a colloidal silica (R972, available from Nihon Aerogel Co., Ltd.). The mixture was then stirred by a Henschel mixer to obtain a toner to be evaluated.

(Image Quality Evaluation Test)

The carriers obtained in the foregoing Examples 1 to 5 and Comparative Examples 1 to 5 were each mixed with the foregoing toner in such a proportion that the toner concentration was 6% to obtain developers to be evaluated. These developers were each subjected to image evaluation test using a remodelled version of VIVACE400 available from Fuji Xerox Co., Ltd. The results are set forth in Table 1. Table 1 shows that the carriers of Examples 1 to 5 exhibit a good image stability as compared with those of Comparative Examples 1 to 5.

TABLE 1

| | Initial | | | After 100,000 sheets of duplication | | | After 200,000 sheets of duplication | | |
|---|---|---|---|---|---|---|---|---|---|
| Example No. | Density on solid area | Carrier attach-ment | Stain on background | Density on solid area | Carrier attach-ment | Stain on background | Density on solid area | Carrier attach-ment | Stain on background |
| Example 1 | Good | None | None | Good | None | None | Good | None | None |
| Example 2 | Good | None | None | Good | None | None | Good | None | None |
| Example 3 | Good | None | None | Good | None | None | Good | None | None |
| Example 4 | Good | None | None | Good | None | None | Good | None | None |
| Example 5 | Good | None | None | Good | None | None | Good | None | None |
| Example 6 | Good | None | None | Good | None | None | Good | None | None |
| Comparative Example 1 | Good | None | None | Low | Partly | Partly | Low | Yes | Yes |
| Comparative Example 2 | Good | None | None | Good | None | None | Good | Partly | Partly |
| Comparative Example 3 | Good | None | None | Low | None | Partly | Low | Partly | Yes |
| Comparative Example 4 | Good | None | None | Low | None | None | Low | Partly | Partly |

TABLE 1-continued

| | Initial | | | After 100,000 sheets of duplication | | | After 200,000 sheets of duplication | | |
|---|---|---|---|---|---|---|---|---|---|
| Example No. | Density on solid area | Carrier attach-ment | Stain on background | Density on solid area | Carrier attach-ment | Stain on background | Density on solid area | Carrier attach-ment | Stain on background |
| Comparative Example 5 | Good | None | None | Good | None | None | Good | Partly | Partly |

In the results above, "Density" was evaluated by that image having less than 0.8 of Macbeth density was unacceptable, "Carrier Attachment" was evaluated by that copied image on A4 sized paper having 10 or more of stain spots caused by carrier attachment was unacceptable, and "Stain on Background" was evaluated by that copied image in which stain at the background was visually recognized was unacceptable.

In accordance with the foregoing constitution of the present invention, a carrier having an enhanced maintenance of image quality can be provided. The carrier of the present invention can be prevented from being attached to the image. Thus, an image free of uneven density and background stain can be obtained.

While the invention has been described in detail and with reference to specific embodiments thereof, it will be apparent to one skilled in the art that various changes and modifications can be made therein without departing from the spirit and scope thereof.

What is claimed is:

1. An electrostatic image developing carrier comprising ferrite, which has a copper content of from 0.1 ppm to 2,500 ppm, a zinc content of from 0.1 ppm to 5,000 ppm and a nickel content of from 0.1 ppm to 2,000 ppm.

2. The electrostatic image developing carrier as claimed in claim 1, wherein said ferrite has a copper content of from 1 to 2,000 ppm, a zinc content of from 1 to 4,000 ppm and a nickel content of from 1 to 1,500 ppm.

3. The electrostatic image developing carrier as claimed in claim 1, wherein said ferrite contains a divalent metal selected from the group consisting of Mn, Mg, Ca, Sr and Ti.

4. The electrostatic image developing carrier as claimed in claim 1, wherein said ferrite is covered by a synthetic resin so that said ferrite forms a core.

5. The electrostatic image developing carrier as claimed in claim 4, wherein said synthetic resin is a vinyl polymer, a silicone polymer, a polyester polymer or a mixture thereof.

6. The electrostatic image developing carrier as claimed in claim 4, wherein said synthetic resin is a vinyl polymer.

7. The electrostatic image developing carrier as claimed in claim 6, wherein said synthetic resin is an acrylic acid polymer or an ester thereof.

8. The electrostatic image developing carrier as claimed in claim 4, wherein the synthetic resin to cover the core comprising the ferrite is from 0.5 to 5% by weight based on the carrier.

9. The electrostatic image developing carrier as claimed in claim 4, wherein the average particle diameter of the core is from 20 to 120 μm.

10. An electrostatic image developer, which comprises an electrostatic image developing carrier comprising a ferrite which has a copper content of from 0.1 ppm to 2,500 ppm, a zinc content of from 0.1 ppm to 5,000 ppm and a nickel content of from 0.1 ppm to 2,000 ppm and a toner having an average grain diameter of from 5 to 15 μm.

* * * * *